US006105960A

United States Patent [19]

Carames

[11] Patent Number: 6,105,960

[45] Date of Patent: Aug. 22, 2000

[54] MACHINE FOR COMPETITION AND LEISURE GAME BY MOVING A FLOATING CHIP

[76] Inventor: Jose Antonio Carames, Calle Pintor Soralla No. 3, E-)8210 Barbera del Valles, Barcelona, Spain

[21] Appl. No.: 08/820,911

[22] Filed: Mar. 19, 1997

[51] Int. Cl.[7] ..... A63F 7/07

[52] U.S. Cl. ..... 273/108.1; 273/108.55; 273/126 A

[58] Field of Search ..... 273/108.55, 108.56, 273/119 A, 118 A, 118 D, 126 R, 126 A, 317.1, 317.4, 317.5, 317.6, 108.1

[56] References Cited

U.S. PATENT DOCUMENTS 3,910,580 10/1975 Leonhart .
4,017,078 4/1977 Goldfarb et al. .
4,173,341 11/1979 Olliges .

FOREIGN PATENT DOCUMENTS 2 098 493 4/1982 United Kingdom .
WO 93/22014 11/1993 WIPO .
WO 95/24247 9/1995 WIPO .

*Primary Examiner*—Sebastiano Passaniti
*Attorney, Agent, or Firm*—Peter F. Corless; Robert L. Goldberg; Christine C. O'Day

[57] ABSTRACT

Machine for playing competition and leisure game between two participants who can compete by actuation of a chip which floats on a gameboard by means of air blown from orifices provided in the board itself and which has underneath a high pressure chamber forming part of a closed circuit of air pressures. The chip is actuated by means of control systems, which are comprised of linear displacement bodies incorporating impulsers which act controllably as a function of the situation of push-buttons and presence sensors of the control unit. The goals are obtained by succeeding in making the chip go beyond the goal lines which are defended by the control systems; once the chip has passed over the goal line, it goes into the corresponding goal area wherein the chip is detected and the point is accounted for whereafter the chip may be taken out back to the playboard.

5 Claims, 4 Drawing Sheets

MACHINE FOR COMPETITION AND LEISURE GAME BY MOVING A FLOATING CHIP

OBJECT OF THE INVENTION.

The object of the invention is a machine for a competition and leisure game by moving a floating chip. It has been especially conceived to allow the game to be played by two participants, one on either side of the gameboard, shooting a discoid chip which floats over the gameboard on a cushion of air when one of the participants is unable to stop the chip from crossing his goal line by use of his special controls, the chip enters the goal area and a goal is scored, the chip being stored in the interior of the machine.

The floating chip is stopped or repelled by activating the control units which, depending on how they are operated, either cause the control centre to emit an order for the automatic repulsion of the chip which has been detected by the presence sensors that send information to the aforementioned centre, or, by another operation, provoke the voluntary action of the electromagnetic elements independently of the presence or absence of the chip in the detection area of the sensors.

More specifically, the invention centres on the way the orders to the electromagnetic elements are carried out following the action of the control units and the data supplied by the presence sensors, the positioning of these sensors and their situation in relation to the goal area, as well as the composition of this area and that of the generating system of the closed circuit of air pressures.

ANTECEDENTS OF THE INVENTION

Fundamentally the means employed to facilitate the movement of the game chip, which floats on a cushion of air, over the gameboard are described in document PCT/ES 94/00024 of the inventor himself. According to this document, the proposal is for a machine for competition and leisure, by the action of repulsion devices, in which two participants play by shooting a chip to each other. The chip moves over a rectangular gameboard which has a longitudinal curve. The underside of the chip is hollow and it is maintained afloat by means of air blown from orifices in the board. The chip is launched by a line of repulsion devices at either end of the board and between each pair of repulsion devices there are sensors which detect the chip and pass the information to a control circuit. This acts on one or two of the repulsion devices activating them if the corresponding player's game control is situated in front of the player or in front of the selected repulsion devices. If the control is neither in front of the player nor in front of the selected repulsion devices, a goal is scored against the player. In this machine the action of repulsion is carried out by electromagnetic devices described in the inventor's patent document PCT ES 93/00038. This document proposes a system for the repulsion of a chip or test ball in machines for competition and leisure. The system consists of a group of independent mechanisms, each of which has the capacity to repulse a chip or test ball within its field of action.

The composition of repulsion devices is known and to this effect patent document U.S. Pat. No. 283,019, in which a repulsion device is proposed, can be quoted as being the previous situation of the technique.

Practical realization of the invention mentioned in PCT ES/94/00024 results in a superautomatic machine which, although very attractive, given its complexity can only be mastered by a limited sector of the public. It is also very complex both to manufacture and to maintain later. The fact that it works through a conventional air pressure system, absorbing air from the exterior atmosphere, causes the different parts of the machine to become dirty and, given the large number of movement and presence sensors, makes frequent cleaning and maintenance operations necessary. The aforementioned factors mean that in spite of being a worldwide novelty, there are many limitations on its use due to its complex operation and maintenance.

For all the above-mentioned reasons, a new generation of improved machines for competition and leisure games moving a floating chip is necessary; where the limitations of the previously-invented machine are overcome and new devices are incorporated to provide solutions which make the machines more reliable, simple, participative and above all easy to maintain.

The newly-invented machine differs from the previous machine as described in PCT ES 94/00028 in that it uses a new system which creates different air pressures using a closed circuit system in order to avoid breakdown due to dust and dirt. The repulsion of the chip as laid out in the invention is also carried out in a different manner: through the movement, of a new system of mobile controls fitted with a set of repulsion devices which, with capacity to cause automatic repulsion and using far fewer sensors and repulsion devices than used by the previous model, move directly, together with the control system, which can detain the chip and with which it is possible, by moving the controls, to produce, at will, either automatic repulsion or the voluntary action of the repulsion devices independently of the presence or absence of the chip in the detection area.

In a new, different system of goal areas from which the chip can be launched, the registering of a goal against is also produced differently; not by detection of the chip in a detector area where repulsion capacity has not been activated by positioning the controls, but by detection of the chip's presence inside the goal areas where it will have physically situated itself if the player has been unable to stop its path. The chip will be stored there until the player provokes its launch and brings it into play.

For the above reasons it is necessary to produce the new machine, so that there are these advantages in its use and previous deficiencies are overcome.

EXPLANATORY DESCRIPTION OF THE INVENTION

The invention is centred, departing from the machine proposed in PCT ES 94/00028, on a new configuration of improved machine for competition and leisure game by moving a chip which floats on a cushion of air. The floating is achieved by the use of a closed circuit with different air pressures which produce high pressure in an area underneath a gameboard with orifices through which air is blown The gameboard is also equipped with special goal areas fitted with an enclosure for storing the gamechip and an expulsion system or "serve" of the chip after the goal is scored. This machine is closed to the exterior except for the systems for holding and moving the specific new control systems. Through these, the chip's access to the goal area can be protected and, according to the player's choice, the chip can be automatically repulsed if it enters their area of action, or their repulsion devices can act voluntarily independently of the presence or absence of the chip in their area of movement.

The new machine according to the invention we describe herein proves to be a better product, in that the new design, on being able to improve the toughness of its structure, the easiness of understanding the working of the game and its lower maintenance costs results in a more useful product, both here and abroad.

According to the invention, each of the two control units is made up of a mobile device or carrier part which slides from side to side along a guide-rail or bar to which it is attached by means of sliding devices. To this carrier device is attached a control device with a revolving ball which is for the player to hold in order to place the control in the desired position within its longitudinal space, and on the other, situated so as to allow a tilting movement along a turning axis, a platform containing a set of sensors and impulse devices is fixed in such a way that it keeps them fixed at a predetermined height above the surface of the gameboard whatever their longitudinal position may be in relation to the goal line.

Each control unit incorporates push-buttons on the left and right sides of the mobile control device. The purpose of these push-buttons is to control the action of the impulsers that the control itself contains by selecting, through their occasional or continuous operation, either the action of the impulsers independently of the presence or absence of a chip in their field of action, or their automatic action with detection by presence sensors in their field of action.

Behind each of the lines defended by the groups of impulsers in each of the control units are the storage areas of the corresponding goal areas, which are fitted with sensors to detect the presence of a chip inside and also with serve systems which produce the ejection of the chip towards the gameboard through the external action of the player using the relevant controls.

DESCRIPTION OF THE DRAWINGS

In order to illustrate what is set out in this document, this descriptive record is accompanied by various pages of drawings which show clarifying parts of the invention in an illustrative, rather than a limitative, way.

DESCRIPTION OF A PRODUCTION METHOD AS AN EXAMPLE

Figure 1:
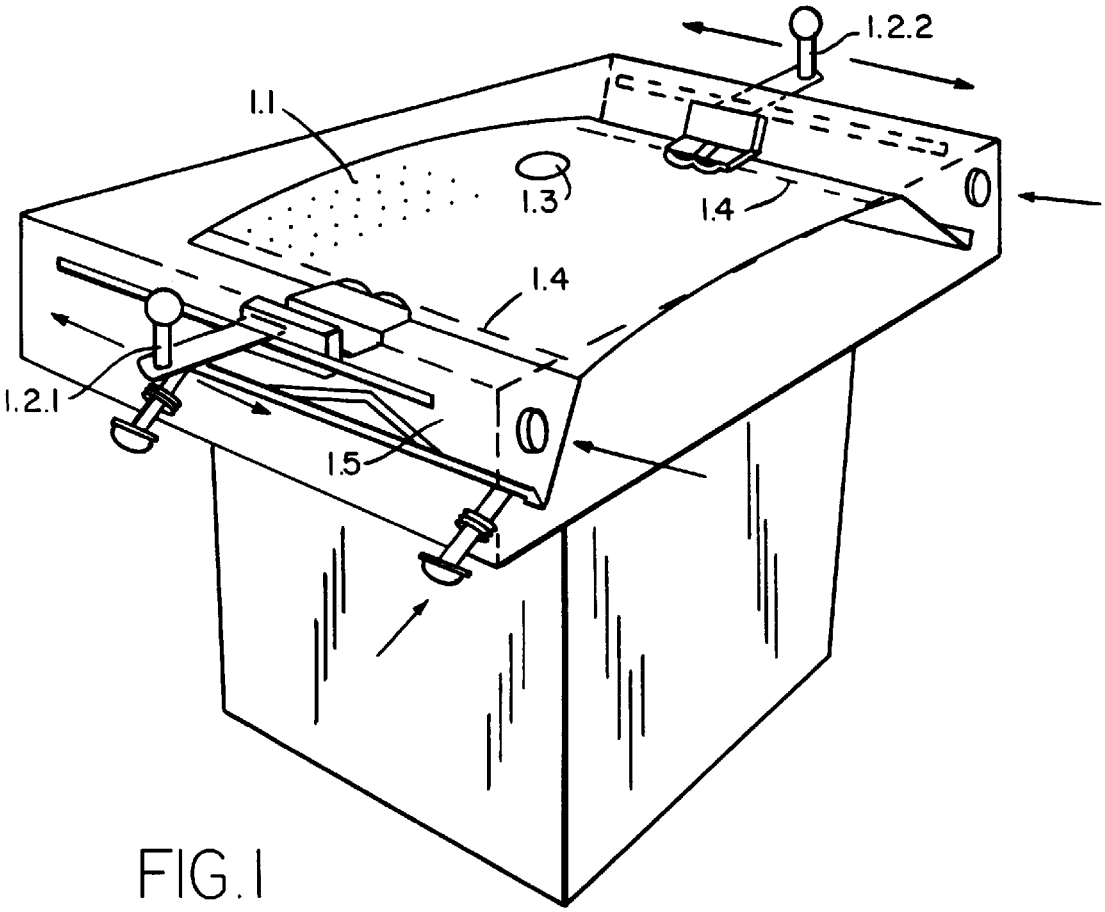
In FIG. 1 a simplified view gives us an outline of the machine like that described here, with a gameboard showing the two control units which contain the sets of impulsers that operate the aforementioned gameboard. Also shown are the orifices in the board for blowing out pressurized air and the goal area enclosures behind the lines defended by the sets of impulsers.
Figure 2:
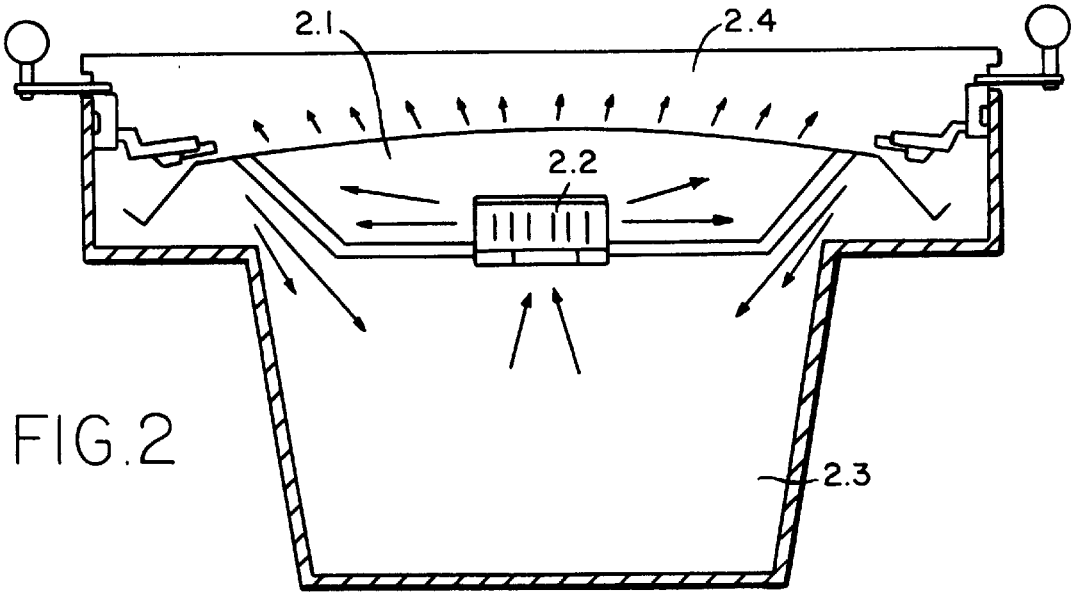
In FIG. 2 a longitudinal section of the machine is shown, in which the structure of the closed circuit of air pressures can be appreciated.

In accordance with the drawings described, it is foreseen that the machine for competition which is the object of invention will, as can be appreciated in FIG. 1, be a machine with a gameboard(1.1) and control unit(1.2)in which a closed circuit of air pressures has been created which,as can be seen in FIG. 2, is made up of a high pressure chamber (2.1) which is produced by a turbine(2.2), a low pressure chamber(2.3) which is generated by air intake by the turbine itself and a compensation area(2.4) where the pressurized air blown out through the orifices on the gameboard(1.1) is received and from where the low pressure chamber takes in air, thus closing the circuit with clean air without having to take in air from the exterior which could contain grease or dust. In this case a machine is constructed with main body dimensions of 1300 by 700 by 200, which gives us an air pressure body with a capacity of 95 litres and the equivalent of 56 square centimetres of air blowing out given the sum of the 1240 orifices for blowing out air situated on the gameboard, each of 1.8 mm in diameter, with the aim of optimizing the performance of the air pressures system, the air passing from the compensation chamber(2.4) to the low pressure chamber(2.3) total a transit section of 900 square centimetres which do not have any significant influence as transit resistance. In FIGS. 1 and 2 we can see the convexly curved gameboard which is obliquely flat so that the chip (l.3) tends to head towards one of the two goal lines(1.4) by itself, entering the goal area if the set of impulsers in the corresponding control unit does not impede its entry.

Figure 3:
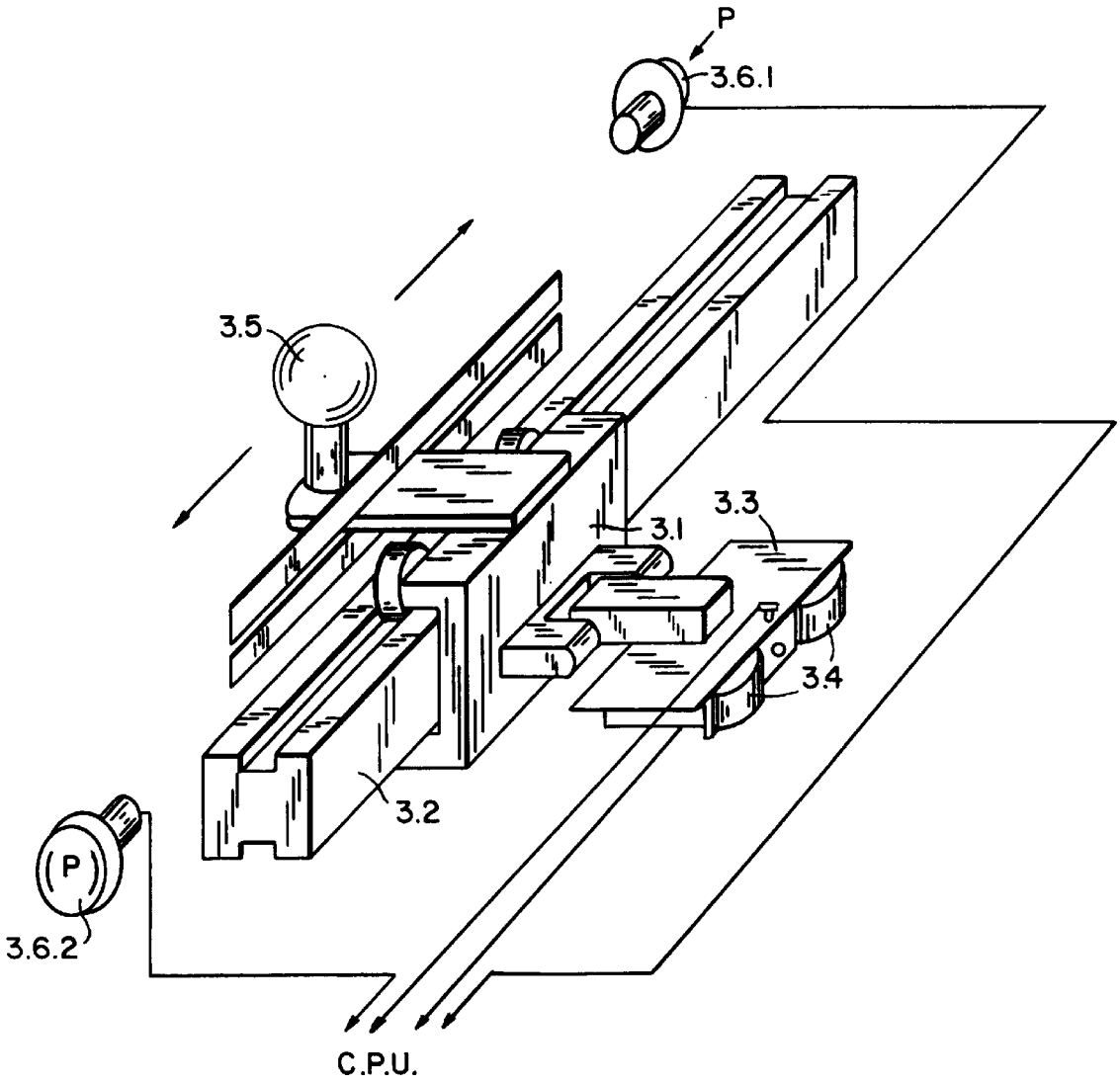
In FIG. 3 a drawing shows a detail from the structure of the control unit with impulse system, in which coils with impulsers, detection sensors, push-buttons governing the movement of the whole and the sliding linear control are indicated.

On both sides of the gameboard are the control units(1.2.1 and 1.2.2) which as can be seen in FIG. 3 are composed, in this case, of a sliding carriage(3.1) with four ball bearings which slide it from side to side along the guide rail(3.2) which in this case is made of a steel bar with an H-shaped profile which allows the ball bearings to roll along the indented parts of the profile without being able to leave their transverse position in relation to the guide rail.

The aforementioned carriage is fitted with a tilting body (3.3) where the group of impulsers are attached(3.4).In this case there are two of them and they are not shown fully to keep the diagrams simple and also as they are known in the trade. The carriage also has a fastening device(3.5) which in this case incorporates a ball which makes it possible to cause it to move along the rail that guides the carriage and which exits to the exterior through a linear joint with a minimal loss of pressure. Each set of controls is also in this case fitted with two push-buttons(3.6.1 and 3.6.2) one on either side, left and right of the goal area located on the outside of the machine construction.

Figure 4:
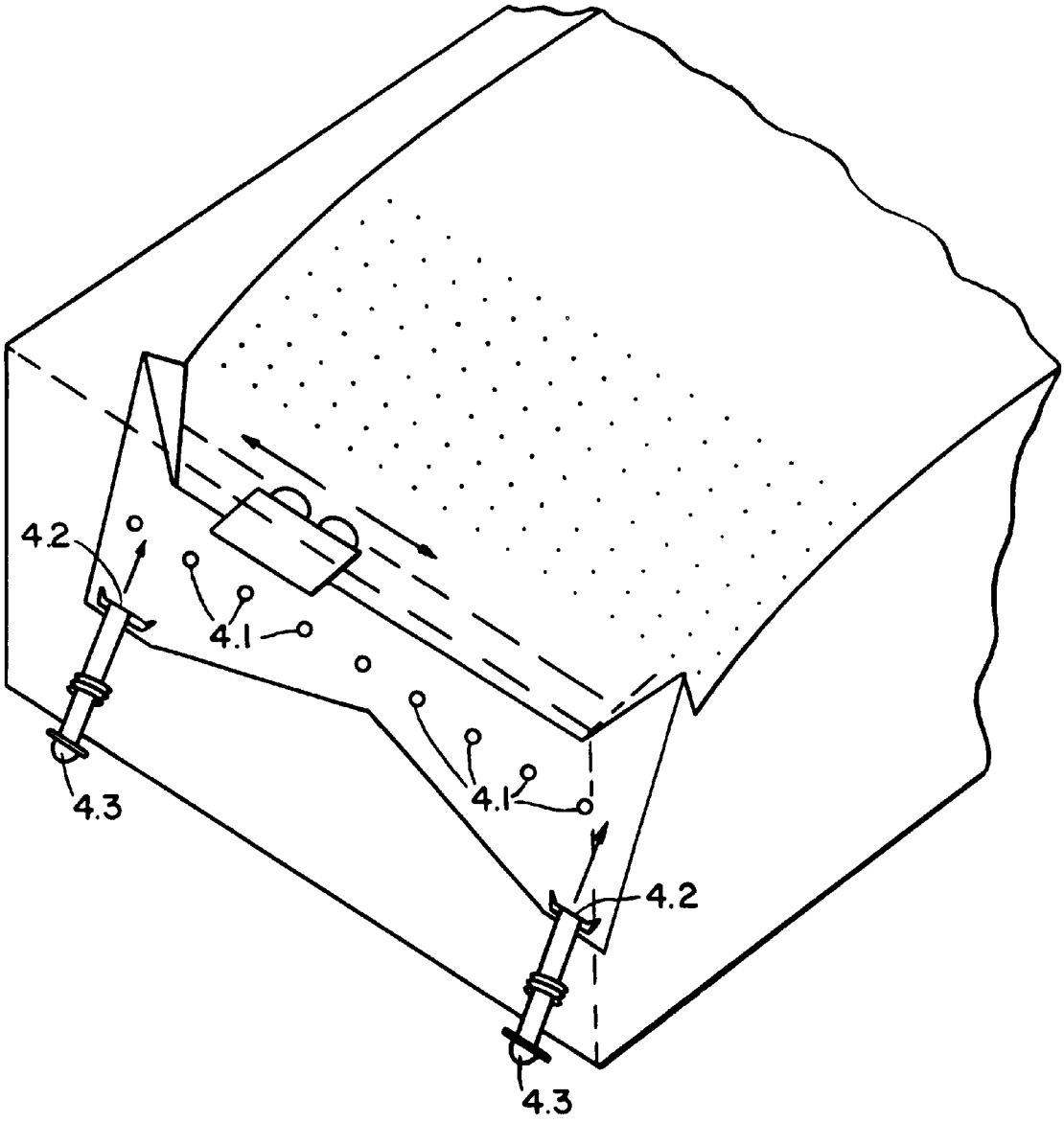
In FIG. 4 an outline is shown of the goal-area system for reception of the chip, detection of it for the purpose of registering the goal,and expulsion of it towards the field of play on carrying out the serve.

Behind the line of movement of the impulsers are the goal area systems (FIG. 4) which are composed of a reception area with detectors(4.1) to recognise the presence of the chip in order to register the goal that has been scored on the chip's entry, storage areas(4.2) where the chip is held until ejected onto the gameboard by activation of an impulser governed in this case by the simple, relevant push-button.

Figure 5:
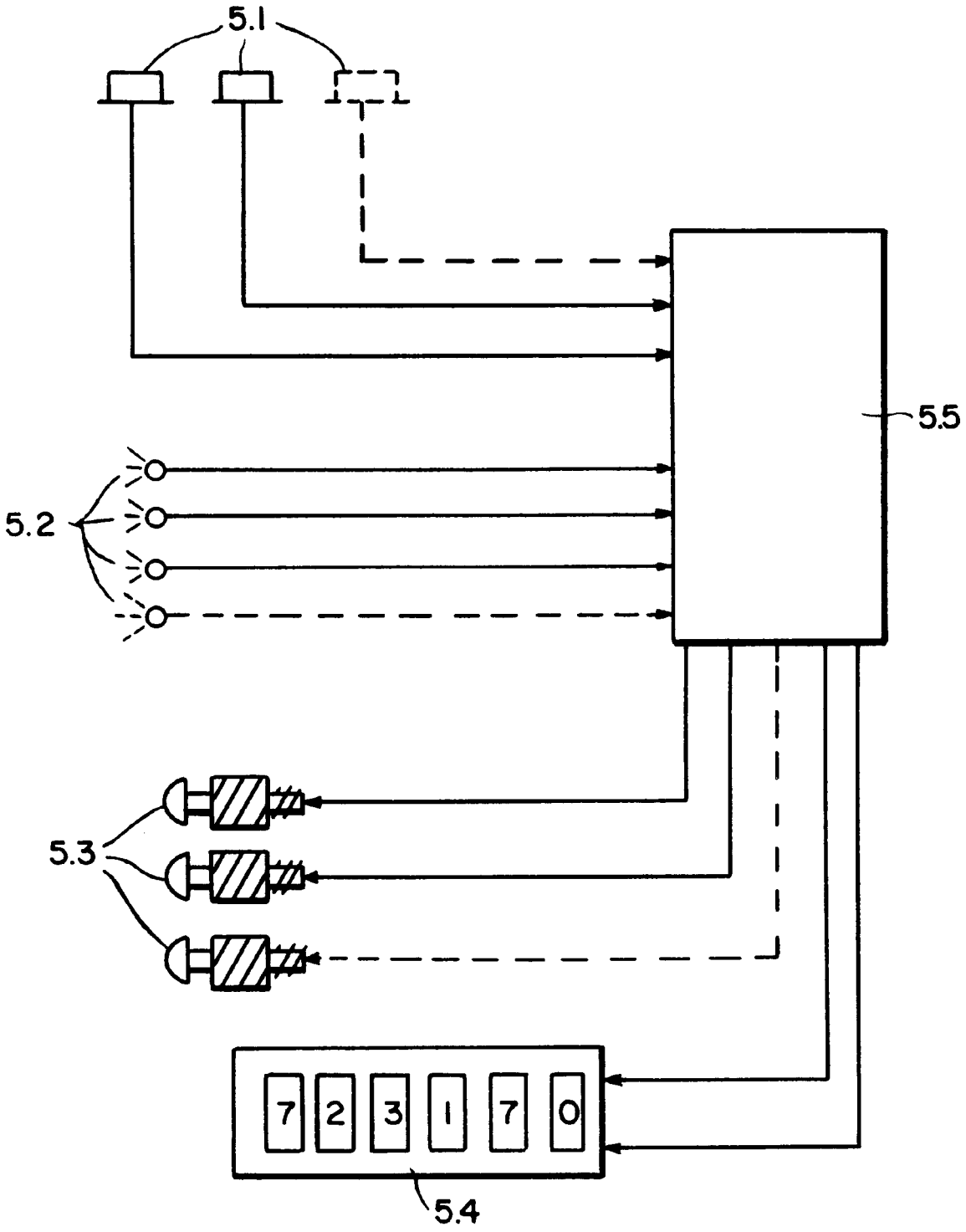
In FIG. 5 is a diagram of the connection of the different devices of the machine to the electronic control system.

The dotted lines in FIG. 5 indicate the direction of the different signals emitted and received by the different devices, such as push-buttons(5.1),sensors(5.2), electrorepulsion devices(5.3) and visualization displays(5.4) towards a conventional control circuit formed by a microprocessor and peripherals.

Within the technique described there is room for modifications which are within any expert's reach and, being common knowledge, do not constitute inventive activity or development.

In any case, any modification to the control system managed by the player will not be significant because it will tend to emulate what has been described.

It is not considered necessary to further extend this document so that any expert in the subject can put the object of the invention into practice staying within the essence of what is described in the following pages in the claims.

What is claimed is:

1. An improved machine for competition and leisure by moving a floating chip, comprising:

a game board;

a discoid chip, said chip being moveable relative to the game board surface;

a group of repulsion devices having longitudinal mobility, said repulsion devices being capable of detaining or repelling the chip;

a control unit capable of activating the repulsion devices and permitting movement of the repulsion devices, said control unit further comprising a group of impulsers;

a goal area located behind the impulsers and defined by a line of movement across the transverse extent of the game board surface; and a chip detecting sensor located within the goal area, said sensor being capable of registering chips that penetrate the goal area.

2. A machine of claim 1, wherein the repulsion devices may be manually activated by push buttons located on the control unit, or automatically activated on detection of the chip by the chip detecting sensor.

3. A machine of claim 1, wherein the goal area further comprises a storage area for chips having entered the goal area, said storage area further comprising an ejection device, capable of launching the chip toward the game board upon external activation.

4. A machine of claim 1, wherein the game board comprises orifices through which pressurized air is blown to facilitate movement of the chip, and wherein the pressurized air is obtained by use of a closed circuit system of air circulation located below the game board, said system comprising chambers with different air pressures and a turbine for impelling the air from one chamber to another chamber.

5. A machine of claim 4, wherein the game board, the chambers with different air pressures, the goal area and the storage area for chips are enclosed by a transparent cover, and wherein the activation controls remain accessible from the exterior of the cover.

* * * * *